United States Patent [19]

Iwao et al.

[11] Patent Number: 4,610,638

[45] Date of Patent: Sep. 9, 1986

[54] INFANT ACTIVITY TOY

[75] Inventors: Noriaki Iwao; Fuyuki Katsumata, both of Tokyo, Japan

[73] Assignee: Tomy Kogyo Co. Inc., Tokyo, Japan

[21] Appl. No.: 726,023

[22] Filed: Apr. 23, 1985

[30] Foreign Application Priority Data

Apr. 26, 1984 [JP] Japan ..... 59-61932[U]

[51] Int. Cl.[4] ..... A63H 1/06

[52] U.S. Cl. ..... 446/241

[58] Field of Search ..... 446/241, 236, 237, 266, 446/431; 273/141 R, 141 A, 142 R

[56] References Cited

U.S. PATENT DOCUMENTS

| | | | |
|---|---|---|---|
| 1,756,608 | 4/1930 | Reider | 446/241 X |
| 2,486,752 | 11/1949 | Michael | 446/241 X |
| 2,961,796 | 11/1960 | Davis | 446/241 X |
| 3,395,482 | 8/1968 | Sarro | 446/241 |

*Primary Examiner*—Mickey Yu

*Attorney, Agent, or Firm*—K. H. Boswell

[57] ABSTRACT

An activity toy, having a spherical housing which is flattened at its poles so as to be supportable at two places on a support surface, has an elongated helical member which extends within the interior from one of the poles to the other. A bushing is fitted around the helical member and is sized so as to very lightly frictionally engage the helical member whereby when it moves along the longitudinal axis of the helical member, the friction between it and the helical member rotates it on the helical member. A collar is located around the bushing. The collar is free to spin independent of the bushing. However, during travel of the bushing along the helical member, the rotation of the bushing is communicated to the collar. The collar includes a plurality of axles which extend away from the collar, each of which carries an object on its end. Upon inversion of the toy, the combination bushing, collar, and objects on the collar spin down the helical member, with the collar and the objects attached thereto further spinning on the bushing upon the bushing reaching its downward limit of travel.

14 Claims, 3 Drawing Figures

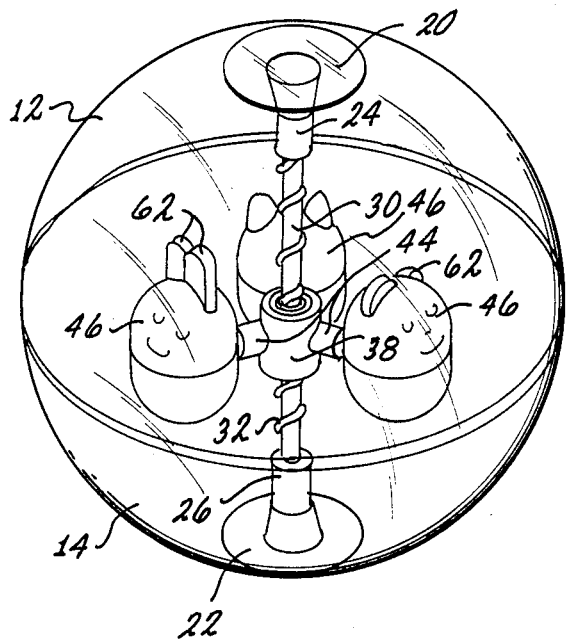
FIG. 1
FIG. 3
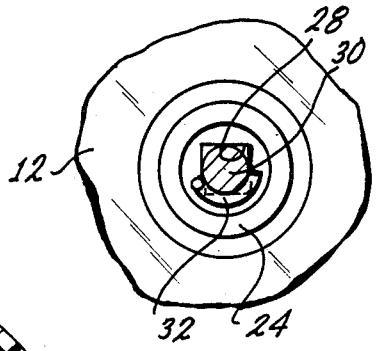
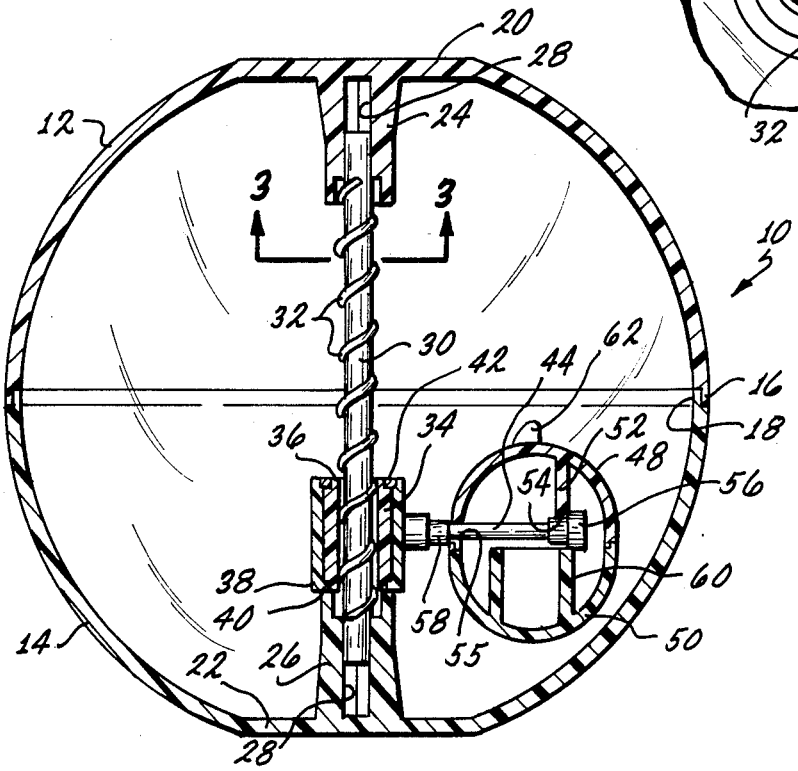
FIG. 2

INFANT ACTIVITY TOY

BACKGROUND OF INVENTION

This invention is directed to an activity toy for children of tender age which includes a helical member located within a housing. Surrounding the helical member so as to move on the helical member is a bushing, and surrounding the bushing so as to rotate on the bushing is a collar.

Because of the tendency of infants and young children to place objects within their mouths, toys constructed for this age group must take this into consideration. "Action" type toys which are interesting or fascinating because of the movement associated therewith, generally include one or more moveable parts. For the most part, most action toys are incompatible with the infant age group because of the necessity of having hinged or moveable parts which the infant or young child want to place within their mouth.

In order to solve this, several toys are known which utilize a hollow, spherical member as an outer protective shell which includes a moveable object inside. The object is moved upon rolling of the spherical member. The simplest of these types of toys locates a loose object within the spherical or other sealed member. These toys can be further sophisticated by further including an axle which traverses the diameter of the spherical member and has a figurine or other object rotatably mounted on the axle so as to rotate about the axle in response to rolling of the toy when the axle is in a horizontal position. A further sophistication of this type of toy utilizes a freely floating spindle located within a sphere having a figurine attached thereto which will roll or flip irrespective of direction of the rotation of the sphere because of the freely floating nature of the spindle.

The above referred to toys only exhibit action when they are actually being rolled. Once the toy stops or comes to rest, the action also ceases. In view of this, the toy essentially can only be played with as a rolling toy.

BRIEF DESCRIPTION OF THE INVENTION

It is considered that there exists a need for new and improved activity toys for young children or infants which are capable of exhibiting modes of action not necessarily restricted to rolling action. It is therefore a broad object of this invention to fulfill this need. It is an additional object of this invention to provide a toy which is capable of being continually inverted, and upon each inversion of the toy, producing a mechanical output characterizing an action of the toy. Further, it is an object of this invention to provide a safe toy for use by infants and small children which has a sophisticated action yet is totally sealed so as to prevent accidental swallowing or other misuse of the toy by the infant or small child. Additionally, it is an object of this invention to provide a toy which, because of its engineering and manufacturing principles embodied therein, is capable of producing an interesting output, yet is economically available to the consumer.

These and other objects, as will become evident from the remainder of the specification, are achieved in an activity toy which comprises: an invertible housing having a hollow interior, at least a portion of said housing being transparent so as to allow viewing of said hollow interior of said housing; an elongated helical member located within said hollow interior of said housing; a cylindrical bushing located around and encircling a portion of said helical member, said bushing sized and shaped so as to loosely frictionally engage said helical member whereby said bushing rotates around said helical member in response to movement of said bushing along the length of said helical member; a cylindrical collar having a hollow interior and open ends, said bushing located within the interior of said collar with said helical member passing through the ends of said collar; means located on at least one of said bushing and said collar for retaining said bushing within the interior of said collar and allowing said collar to freely rotate around said bushing; further means attaching said collar to increase the mass of said collar whereby upon inversion of said housing said further means and said collar and said bushing rotate as said bushing travels down said helical member and said further means and said collar continue rotating around said bushing when said bushing reaches the limit of its downward travel along the length of said helical member.

In the illustrative embodiment of the toy, a flange is located at each of the ends of the cylindrical with the flanges being sized so as to encapsulate the bushing within the collar allowing rotation of the collar with respect to the bushing, but retention of the collar on the bushing. Further, a plurality of axles are attached to the collar and extend away from the collar along a direct which is perpendicular to an axis passage through the ends of the collar. A rotating member is attached to the ends of each of the axles. In the illustrative embodiment, the rotating members are capable of rotating about the respective axles and are weighted so as to rotate on each inversion of the housing.

BRIEF DESCRIPTION OF THE DRAWINGS

This invention will be better understood when taken in conjunction with the drawings wherein:

FIG. 1 is an isometric view of a toy of this invention;

FIG. 2 is a side elevational view in section of the toy of FIG. 1; and

FIG. 3 is a fragmentary plan view about the line 3—3 of FIG. 2.

The invention described in this specification and illustrated in the drawings utilizes certain principles and/or concepts as are set forth in the claims appended hereto. Those skilled in the toy arts will realize that these principles and/or concepts are capable of being utilized in a variety of embodiments which may differ from the exact embodiment utilized for illustrative purposes. For this reason, this invention is not to be construed as being limited solely to the illustrative embodiment, but should only be construed in view of the claims.

DETAILED DESCRIPTION OF THE INVENTION

A toy 10 of the invention is shown in FIG. 1. It is an activity toy primarily designed for use by infants and toddler age children. A first transparent hemispheric housing 12 is attached to a second transparent hemispheric housing 14 utilizing interlocking skirts 16 and 18 formed on the respective housings 12 and 14 which are solvent welded together on final assembly of the toy. The hemisphere 12 has a flattened area 20, and the hemisphere 14 has a flattened area 22. These provide for resting positions for the toy 10 and allowing it to be inverted from one resting position, as for instance resting on the flattened area 22 seen in the figures, to where it is resting on the other flattened area 20. The flattened areas 20 and 22 are positioned opposite each other essentially on the "poles" of the sphere formed by housings 12 and 14.

Aside from the flattened areas 20 and 22, the remainder of the housing 12 is spherical in shape allowing for rolling of the toy 10 on an appropriate surface, or the like. Thus, the toy 10 can be utilized as a normal rolley polley type toy, or it can simply be continuously inverted to actuate certain internal components.

A boss 24 located within the interior of the toy 10 extends from the underside of flattened area 20 toward the center of the toy 10. A similar boss 26 extends in a like manner from the flattened area 22. This positions the bosses 24 and 26 along a diameter of the sphere formed by housing 12 or 14.

Each of the bosses 24 and 26 includes a bore 28 which is square in the portion of the bore near the flattened area 20 or 22, and rounded toward the center of the toy 10. A central shaft 30 fits in the bore 28 in the rounded portion thereof and bottoms out against the square portion. This retains the shaft 30 in the respective bosses 24 and 26 and locates the shaft 30 such that it is perpendicular to the flattened areas 20 and 22 on the outside surface of the toy 10. When the toy 10 rests on either of its flattened surfaces 20 or 22, this essentially positions the shaft 30 in a perpendicular direction.

A helical member 32 is located around the shaft 30. The ends of the helical member 32 are located in enlarged areas of the opening of the bores 28. This fixes the helical member 32 and prevents rotation of it within the interior of the toy 10. The helical member 32 forms a helical pathway along the shaft 30.

A cylindrical bushing 34 is positioned around the helical member 32. Its internal diameter is chosen such that there is a very weak frictional fit between the bushing 34 and the helical member 32. Because of this, when additional weight is supplied to the cylindrical bushing 34, as hereinafter explained, it is moved along the length of the helical member 32, and in doing so, the weak frictional fit between the bushing 34 and the helical member 32 causes the cylindrical bushing 34 to spiral down along the helical member 32, rotating as it traverses the length of the helical member 32.

The helical member 32 and the shaft 30 are both elongated with respect to their diameter such that they essentially traverse across a diameter line of the spherical shape of the toy 10 between its "poles". The length of the cylindrical bushing 34 is much smaller than the helical member 32 and shaft 30, allowing for the bushing 34 to move longitudinally along the helical member 32.

The wall thickness of the bushing 34 is reduced near each of the open ends of the bushing 34 forming a small skirt 36 on each of the ends of the bushing 34. As such, the thickness of the bushing 34 is greater near its center than it is at either of the skirts 36.

A cylindrical collar 38 surrounds the bushing 34. At all places the internal diameter of the collar 38 is greater than the external diameter of the bushing 34. The collar 38 has open bottom and top ends with an inwardly directed flange 40 intricately molded with the remainder of the collar 38 near one of the ends. As molded, the other end of the collar 38 is opened. During assembly, the bushing 34 is placed within the collar 38 by passing it through the open end, and then a small ring 42 is solvent welded to the interior of the cylindrical bushing 34 at the open end to form a further inwardly directed radially extending flange. Together the flange 40 and the ring 42 (which becomes a second flange after solvent welding) encapsulate the bushing 34 within the collar 38. The interior diameter of both the flange 40 and the ring 42 is larger than the external diameter of the skirts 36 on the bushing 34 such that, while they retain the bushing 34 within the collar 38, they allow free rotation of the collar 38 on the bushing 34.

Three axles, collectively identified by the numeral 44, are intricately formed with the remainder of the collar 38. They extend radially outwardly from the collar 38 and are perpendicular with respect to an axis passing through the open ends of the collar 38. Three rotating members, collectively identified by the numeral 46, are located on the respective axles 44. The members 46 are each formed with an upper housing 48 and a lower housing 50 which are solvent welded together.

A web 52, formed in housing 48, has a slot 54 formed therein which passes around the axle 44. The axle 44 includes an enlarged head 56 which is bigger than the slot 54 and is located on the side of the web 52 opposite the collar 38. The members 46 have a hole 55 formed in their outer wall, and the axles 44 project into the housing 48 through hole 55. And enlarged section 58 on the axles 44 mates against the outside of the rotating members 46, and together the enlarged section 58 and the enlarged head 56 hold the rotating members 46 on their respective axles 44. Because the slot 54 and the hole 55 in the outside walls of the rotating member 46 are of a greater diameter than are the axles 44, the rotating members 46 are free to rotate on the axles 44.

The rotating members 46 include a large central internal boss 60 which adds mass to the bottom housing 50 and also locks the axles 44 within the web 52. When the axles 44 are essentially horizontal, because of the mass of the boss 60 within the housing members 50, the rotating members 46 are biased by gravity so as to be positioned on their axles 44, with their housing members 50 oriented downwardly and their housing members 48 oriented upwardly. The housing members 48 include appropriate material, collectively identified by the numeral 62, molded on their surface, which together with indicia printed on the outside of the housing 48, give the rotating members 46 a characterized figurine appearance.

When the toy, as seen in FIG. 2, is inverted and set on the flattened area 20, the mass of the combined rotating members 46 is biased downwardly by gravity. This force is transferred through the collar 38 to the bushing 34 to slide the bushing 34 downwardly along the helical member 32. Because of the slight amount of frictional engagement between the interior of the bushing 34 and the helical member 32, the bushing 34, as it moves downward on the helical member 32, also is rotated. This rotational momentum builds until the downward travel of the collar 38 and bushing 34 bring them against the top edge of one of the bosses 24 or 26. This stops the downward movement of the bushing 34 on the helical member 32.

During downward movement of the bushing 34 along the helical member 32, the collar 38 and the rotating members 46 attached thereto, were suspended by the bushing 34, and as such, the rotation of the bushing 34 is communicated to them to rotate them. When the bushing 34 and the collar 38 bottom out on top of the appropriate boss 24 or 26, the bushing 34 no longer moves longitudinally along the helical member 32, and as such its rotation also stops. However, since the collar 38 is free to independently spin or rotate on the bushing 34, the rotational momentum imparted to it and to the rotating members 46 attached thereto, continues to rotate the collar 38 and the rotating members 46 until this momentum is lost.

Each time the toy 10 is inverted, the combination of the bushing 34, collar 38, and rotating members 46 move downward along the helical member 32 to rotate these members with the rotation of the rotating members 46 and the collar 38, continuing for a time period after the bushing 34 has reached its limits of travel. Further, upon each inversion, the rotating members 46 rotate on the axles 44 such that they essentially are always upright with the top housing 48 pointed up and the bottom housing 50 pointed down.

The child can, thus, play with the toy 10 by simply continuously inverting it to impart rotation to the rotating members 46. If the child rolls the toy 10, the toy 10 also exhibits an interesting output, in that the inertia of the rotating members 46 will tend to have them rotate at a different speed than rotation of the toy 10, with the collar 38 serving as a bearing on the bushing 34. However, any rotation imparted from the collar 38 to the bushing 34, moves the bushing 34 along the helical member 32 to reposition the rotating members 46 toward one end or the other of the helical member 32, thus, changing the center of gravity of the toy 10 whereby it rolls differently than a perfectly centered sphere. This produces an entertaining output for the infant/toddler playing with the toy 10.

We claim:

1. An activity toy which comprises:

an invertible spherical housing having a hollow interior, at least a portion of said housing being transparent so as to allow viewing of said hollow interior of said housing;

an elongated helical member located within said hollow interior of said housing;

said housing includes first and second flat support areas located on the outside thereof, said first and said second support areas positioned on oppposite sides of said spherical housing;

said helical member located within said housing so as to extend between said first and said second flat support areas;

said housing positionable on said first support area and when inverted positionable on said second support area;

a cylindrical bushing located around and encircling a portion of said helical member, said bushing sized and shaped so as to weakly frictionally engage said helical member whereby said bushing rotates around said helical member in response to movement of said bushing along the length of said helical member;

a cylindrical collar having a hollow interior and open ends, said bushing located within the interior of said collar with said helical member passing through the ends of said collar, said cylindrical collar sized and shaped so as to encase said bushing within said interior of said collar and including means located on said collar for retaining said bushing within the interior of said collar and to allow said bushing to rotate both clockwise and counterclockwise within said interior of said collar when said housing is positioned on both said first support area and said second support area;

further means attaching to said collar to increase the mass of said collar whereby upon inversion of said housing said mass of said further means and said collar and said bushing rotate as said bushing travels down said helical member and said further means and said collar continue rotating around said bushing when said bushing reaches the limit of its downward travel along the length of said helical member.

2. The toy of claim 1 wherein:

said further means include at least one axle means projecting from said collar perpendicular to an axis passing through the ends of said collar and further including rotating means located on said axle so as to rotate about said axle.

3. The toy of claim 2 including:

a plurality of said axle means spaced in an array around said collar with each of said axle means projecting perpendicular from said axis passing through said ends of said collar;

a plurality of said rotating means equal in number to the number of said axle means, each of said rotating means rotatably mounted about one of said axle means.

4. The toy of claim 3 wherein:

said housing includes a first and a second boss located thereon, each of said bosses located within said hollow interior of said housing and positioned on said housing so as to extend toward one another;

said helical member supported on one of its ends in one of said bosses and on the other of its ends in the other of said bosses whereby said bushing and said collar retained thereon travel along the length of said helical member from one of said bosses to the other of said bosses upon each inversion of said toy.

5. The toy of claim 3 wherein:

said means retaining said collar on said bushing comprises an inwardly directed flange located at each of said ends of said collar, each of said flanges projecting radially inwardly from said collar;

said bushing is shaped as an elongated cylinder, said cylinder including an axially oriented skirt located at each of its ends, each of said skirts of a diameter less than the diameter of said bushing intermediate said ends.

6. The activity toy of claim 1 wherein:

said means retaining said bushing within said collar comprises an inwardly directed flange located at each of said ends of said collar, each of said flanges projecting radially inwadly from said collar;

said bushing is shaped as an elongated cylinder, said cylinder of a first diameter adjacent to each of its ends and of a second diameter intermediate said ends and said second diameter is greater than said first diameter.

7. The toy of claim 1 wherein:

when said housing is positionable on either of said first or said second support areas said helical member is positioed essentially perpendicular to said support surface on which said housing is supported.

8. The toy of claim 1 wherein:

said housing includes a first and a second boss located thereon, each of said bosses located within said hollow interior of said housing and positioned on said housing so as to extend toward one another;

said helical member supported on one of its ends on one of said bosses and on the other of its ends on the other of said bosses whereby said bushing and said collar retained thereon travel along the length of said helical member from one of said bosses to the other of said bosses upon each inversion of said toy.

9. An activity toy which comprises:

an invertible housing having a hollow interior, at least a portion of said housing being transparent so as to allow viewing of said hollow interior of said housing;

an elongated helical member located within said hollow interior of said housing;

a cylindrical bushing located around and encircling a portion of said helical member, said bushing sized and shaped so as to weakly frictionally engage said helical member whereby said bushing rotates around said helical member in response to movement of said bushing along the length of said helical member;

a cylindrical collar having a hollow interior and open ends, said bushing located within the interior of said collar with said helical member passing through the ends of said collar;

means located on at least one of said bushing and said collar for retaining said bushing within the interior of said collar and allowing said collar to freely rotate around said bushing, said means retaining said collar on said bushing comprises an inwardly directed flange located at each of said ends of said collar, each of said flanges projecting radially inwardly from said collar;

further means attaching to said collar to increase the mass of said collar whereby upon inversion of said housing said mass of said further means and said collar and said bushing rotate as said bushing travels down said helical member and said further means and said collar continue rotating around said bushing when said bushing reaches the limit of its downward travel along the length of said helical member.

10. The toy of claim 9 wherein:

said housing is spherical in shape.

11. The toy of claim 9 wherein:

said housing includes a first and a second flat support area located on the outside thereof, said first and said second support areas positioned on opposite sides of said housing;

said helical member located within said housing so as to extend between said first and said second support areas;

said housing positionable on said first support area and when inverted positionable on said second support area.

12. The toy of claim 9 including:

a plurality of axle means spaced in an array around said collar with each of said axle means projecting perpendicular from an axis passing through said ends of said collar;

a plurality of rotating means equal in number to the number of said axle means, each of said rotating means rotatably mounted about one of said axle means.

13. The toy of claim 9 wherein:

said bushing is shaped as an elongated cylinder, said cylinder including an axially oriented skirt located at each of its ends, each of said skirts of a diameter less than the diameter of said bushing intermediate said ends.

14. The toy of claim 9 wherein:

said housing includes a first and a second boss located thereon, each of said bosses located within said hollow interior of said housing and positioned on said housing so as to extend toward one another;

said helical member supported on one of its ends in one of said bosses and on the other of its ends in the other of said bosses whereby said bushing and said collar retained thereon travel along the length of said helical member from one of said bosses to the other of said bosses upon each inversion of said toy.

* * * * *

UNITED STATES PATENT AND TRADEMARK OFFICE

CERTIFICATE OF CORRECTION

PATENT NO. : 4,610,638

DATED : September 9, 1986

INVENTOR(S) : Noriaki Iwao

It is certified that error appears in the above-identified patent and that said Letters Patent is hereby corrected as shown below:

Column 2, line 21, after the word " cylindrical" insert the word --bushing--.

Column 2, line 26, "direct" should be --direction--.

Column 2, line 28, "passage" should be --passing--.

Column 3, line 5, change "housing 12 is" to --housings 12 and 14 are--.

Column 3, line 61, "intricately" should be --integrally--.

Column 3, line 62 "opened" should be --open--.

Column 4, line 9, "intricately" should be --integrally--.

UNITED STATES PATENT AND TRADEMARK OFFICE

CERTIFICATE OF CORRECTION

PATENT NO. :4,610,638

DATED : September 9, 1986

INVENTOR(S) : Noriaki Iwao

It is certified that error appears in the above-identified patent and that said Letters Patent is hereby corrected as shown below:

Column 4, line 23, change "And enlarged section 58 on the axles 44 mates" to read --Enlarged sections 58 on the axles 44 mate--.

Column 6, line 57, "positioed" should be --positioned--

Signed and Sealed this

Thirteenth Day of January, 1987

*Attest:*

DONALD J. QUIGG

*Attesting Officer*

*Commissioner of Patents and Trademarks*